US006606835B1

(12) United States Patent
Bilka

(10) Patent No.: US 6,606,835 B1
(45) Date of Patent: Aug. 19, 2003

(54) BLOCKS AND WALLS CONSTRUCTED THEREWITH

(76) Inventor: Augustin J. Bilka, 4244 Moccasin Trail, Woodstock, GA (US) 30189

( * ) Notice: Subject to any disclaimer, the term of this patent is extended or adjusted under 35 U.S.C. 154(b) by 0 days.

(21) Appl. No.: 10/036,138

(22) Filed: Dec. 31, 2001

Related U.S. Application Data

(63) Continuation-in-part of application No. 29/144,964, filed on Jul. 12, 2001, which is a continuation-in-part of application No. 29/136,600, filed on Feb. 2, 2001, now Pat. No. Des. 447,819.

(51) Int. Cl.[7] ..... E04B 5/04; E04C 2/04

(52) U.S. Cl. ..... 52/604; 52/596; 52/604; 52/605; 52/612; 52/311.1; 52/315

(58) Field of Search ..... 52/596, 604, 605, 52/612, 311.1, 315

(56) References Cited

U.S. PATENT DOCUMENTS

| | | | | | |
|---|---|---|---|---|---|
| 117,212 | A | | 7/1871 | Shaw | |
| 444,042 | A | | 1/1891 | Brock | |
| 938,430 | A | | 10/1909 | McQueen | |
| 1,351,546 | A | | 8/1920 | Warmoth | |
| 1,413,169 | A | | 4/1922 | Lawton | |
| 1,422,949 | A | | 7/1922 | Evans | |
| 1,551,544 | A | | 9/1925 | Crooks | |
| 1,727,362 | A | * | 9/1929 | Bone | 52/220.2 |
| 1,794,572 | A | * | 3/1931 | Wyatt | 264/DIG. 57 |
| 2,265,244 | A | | 12/1941 | Neumeister | 72/31 |
| 2,932,745 | A | | 4/1960 | Alberti et al. | 250/108 |
| 2,942,115 | A | * | 6/1960 | O'Connell | 250/517.1 |
| 2,970,218 | A | | 1/1961 | Shaw | 250/108 |
| 3,614,446 | A | | 10/1971 | Leuthold | 250/108 |
| 3,908,326 | A | | 9/1975 | Francis | 52/384 |
| 4,034,533 | A | | 7/1977 | Faas | 52/589 |
| 4,044,520 | A | | 8/1977 | Barrows | 52/309 |
| 4,524,551 | A | | 6/1985 | Scheiwiller | 52/98 |
| 4,642,960 | A | | 2/1987 | Wallover, III | 52/390 |
| 4,646,498 | A | | 3/1987 | Schneller et al. | 52/309 |
| 6,053,661 | A | * | 4/2000 | Lewis | 405/258.1 |
| D431,082 | S | | 9/2000 | Jaros | D25/113 |
| 6,178,715 | B1 | * | 1/2001 | Pacitto et al. | 405/264 |
| 6,253,518 | B1 | * | 7/2001 | Azar | 52/589.1 |
| D447,819 | S | * | 9/2001 | Bilka | D25/113 |

FOREIGN PATENT DOCUMENTS

| | | |
|---|---|---|
| FR | 940509 | 5/1948 |

OTHER PUBLICATIONS

"Edgestone" TM, Pavestone Co. Brochure, Beautiful Edgings You Can Install Yourself, ©2000.

* cited by examiner

*Primary Examiner*—Carl D. Friedman
*Assistant Examiner*—Steve Varner
(74) *Attorney, Agent, or Firm*—Baker, Donelson, Bearman, Caldwell & Berkowitz

(57) ABSTRACT

A cementations block for seating in adjacent and adjoining relation with a plurality of the cementations blocks to define a wall, with each block comprising a body having a top and an opposing bottom, opposing front and back faces, and a first and second opposing ends, with beveled edges along a bottom and side. The top defines a geometric protruding surface and the bottom defines a mating geometric surface, whereby two of the block stacked one on another matingly engage together. The first end defines a protrudence and the second end defines a recess conforming substantially in shape to the protrudence, whereby linearly adjacent blocks matingly engage for assembling a wall therewith, with the beveled surfaces simulating mortar joints between adjacent blocks.

19 Claims, 7 Drawing Sheets

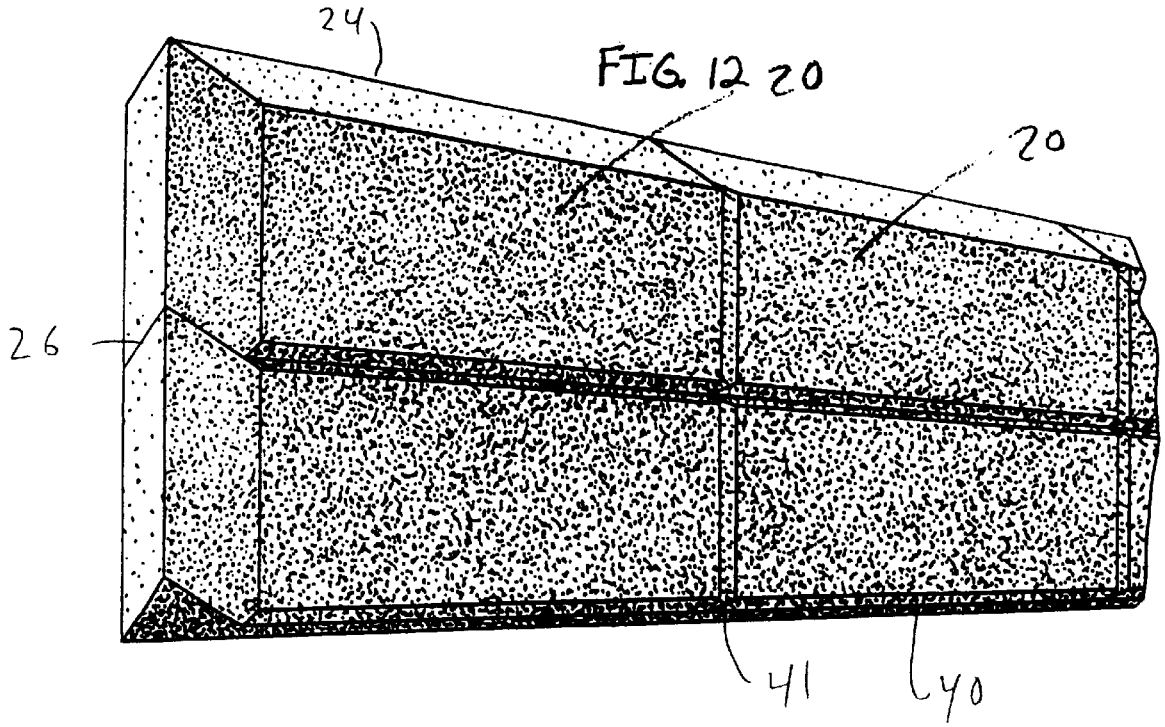
FIG. 12
FIG. 13
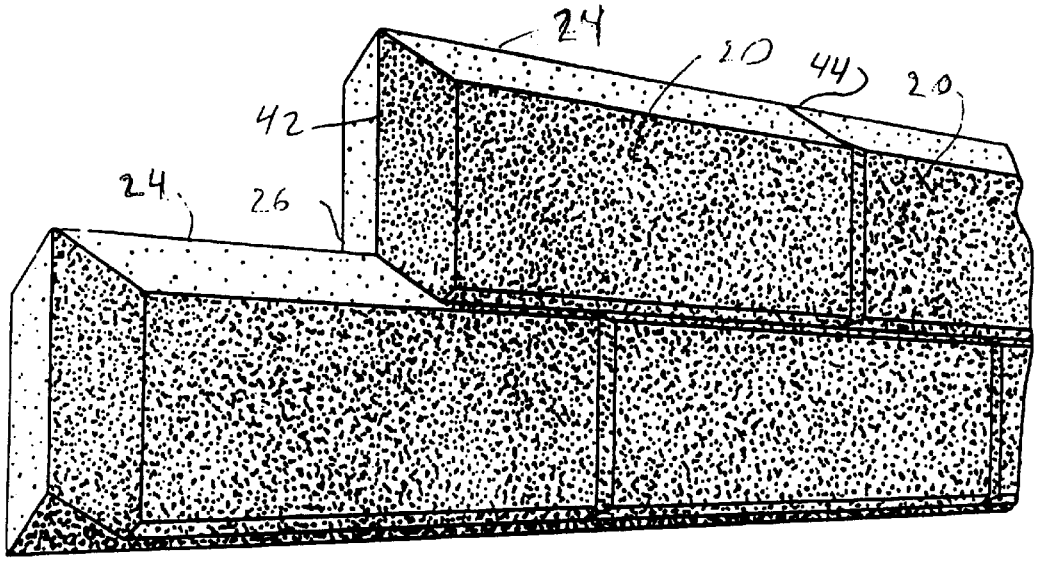

BLOCKS AND WALLS CONSTRUCTED THEREWITH

The present application is a continuation-in-part of application Ser. No. 29/144,964 filed Jul. 12, 2001 which is a continuation-in-part of Ser. No. 29/136,600 filed Feb. 2, 2001, issued Sep. 11, 2001 as U.S. Des. Pat. No. D447,819.

TECHNICAL FIELD

The present invention relates to blocks for walls. More particularly, the present invention relates to interlocking blocks for assembling walls.

BACKGROUND OF THE INVENTION

Blocks, and particularly, blocks of types made of brick and cementations materials have existed for many years. Blocks have long been used for constructing walls for buildings such as homes, offices, fences, and the like. The blocks provide not only an ornamental appearance for the wall, but are rigidly strong and also provide insulative properties for the wall.

Typically, blocks comprise a space-filling body with opposing top and bottom, opposing front and back sides, and opposing ends. Blocks are stacked in a plurality of tiers to define a wall. There are various patterns of stacking blocks during construction of the wall. Most walls constructed of blocks, and typically when using smaller bricks in walls of buildings, the adjacent blocks and tiers are interconnected with a mortar material.

While such blocks have generally provided strong components for walls with thermal and weather resistant properties, there are drawbacks to their use. Skill is required to place the mortar and blocks in tiers for constructing walls. The mortar ages and often must be sealed with a coating to reduce penetration of moisture into the mortar. Without such, the mortar deteriorates and may lead to damage or failure of the wall.

Accordingly, there is a need in the art for improved blocks for assembling walls. It is to the provision of such that the present invention is primarily directed.

BRIEF DESCRIPTION OF THE PRESENT INVENTION

The present invention meets the need in the art by providing a cementatious block for seating in adjacent and adjoining relation with a plurality of the cementatious blocks to define a wall, in which the block has a body with a top and an opposing bottom, opposing front and back faces, and a first and second opposing ends. The top defines a geometric protruding surface and the bottom defines a mating geometric surface, whereby two of the blocks stacked one on another matingly engage together. The first end defines a protrudence and the second end defines a recess conforming substantially in shape to the protrudence, whereby linearly adjacent blocks matingly engage for assembling a wall therewith. The front face is formed of a first material extending from an exterior surface thereof through the body at least to a depth defined by a plane substantially parallel to the exterior surface with a remaining portion of the body extending therefrom to the opposing back face formed of a second material. The front face further defines a beveled first edge extending substantially a length of the body adjacent the bottom and a beveled second side edge extending substantially a height of the body between the bottom and the top.

Objects, features, and advantages of the present invention will become apparent from a reading of the following detailed description of the invention and claims in view of the appended drawings.

BRIEF DESCRIPTION OF THE DRAWINGS

FIG. 12 illustrates a portion of a wall constructed with blocks illustrated in FIG. 1.

FIG. 13 illustrates a portion of a second wall constructed with blocks illustrated in FIG. 1.

DETAILED DESCRIPTION OF THE PREFERRED EMBODIMENTS

Figure 1:
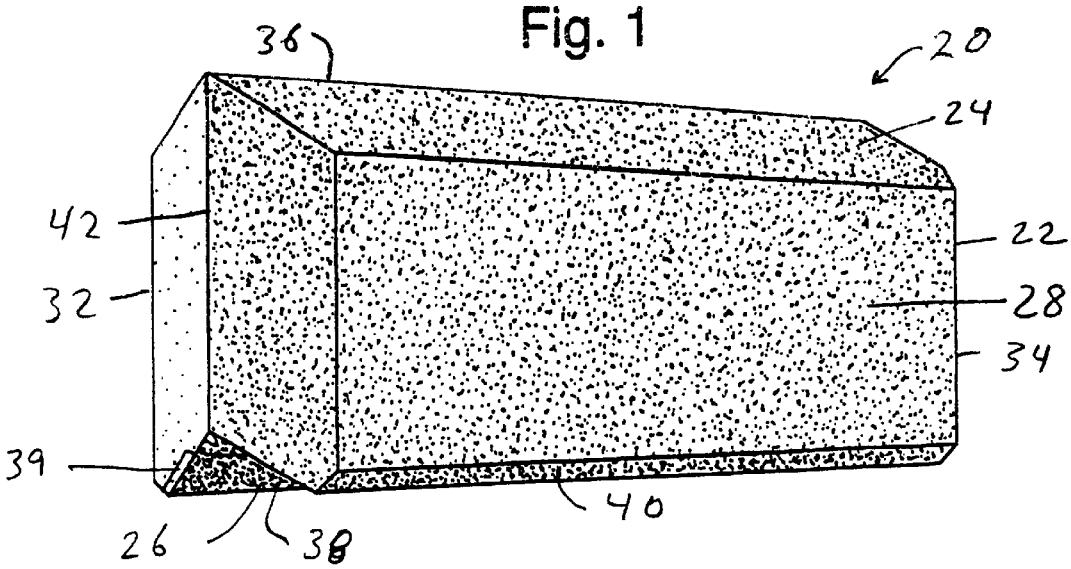
FIG. 1 illustrates a left perspective view of a block according to the present invention.
Figure 1A:
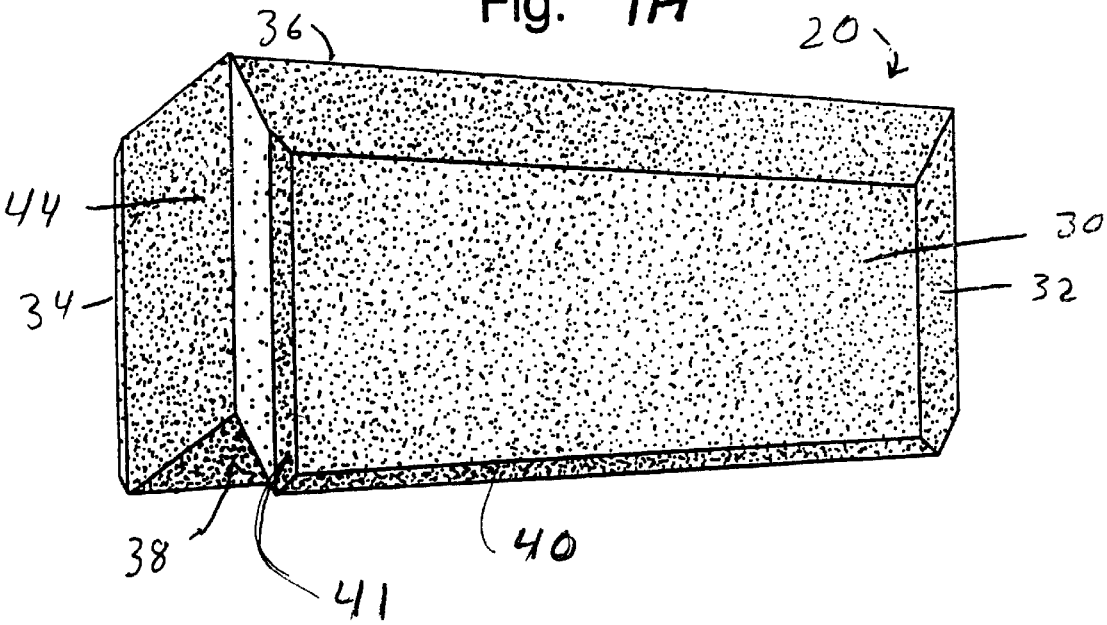
FIG. 1A illustrates a right perspective view of the block illustrated in FIG. 1.

Referring now in more detail to the drawings, in which like numerals indicate like parts throughout the several views, FIGS. 1 and 1A illustrates a left and right perspective view of a block 20 according to the present invention. As discussed below, the block 20 seats in adjacent and adjoining relation in courses or tiers with a plurality of the blocks to define a veneer face for a structural wall. The block 20 comprises a body 22 having a top 24 and an opposing bottom 26, opposing front and back faces 28, 30, and a first and second opposing ends 32, 34. The top 24 defines a geometric protruding surface and the bottom 26 defines a mating geometric surface. Two of the blocks 20 thereby matingly engage when stacked in tiers one on top of another.

In the illustrated embodiment, the geometric protruding surface of top 24 defines a substantially V-shaped protruding surface with a peak 36, while the geometric protruding surface of the bottom 26 defines a mating V-shaped recess or valley 38. The reentrant angle of the peak and the valley is preferably about 45 degrees. A portion of the bottom 26 further defines a notch 39 that is recessed into a side face of the bottom, for a purpose discussed below.

In the illustrated embodiment, the front face 28 further defines a beveled edge 40 that extends substantially a length of the block 20 adjacent the bottom 26. The front face defines a beveled side edge 41 that extends substantially a height of the block between the opposing top and bottom surfaces. The beveled edges 40, 41 cooperatively define an ornamental appearance for a wall made with the blocks 20, by defining simulated masonry joints between blocks in adjacent tiers and between linearly adjacent blocks in a course.

The first end 32 defines an outwardly extending protrudence 42. As illustrated in FIG. 1A, the opposing second end 34 defines a recess 44 conforming substantially in shape to the protrudence 42. A pair of the blocks 20 linearly aligned in adjacent relation matingly engage with the protrudence 42 received in the recess 44 for assembling a wall.

The block 20 in a preferred embodiment is made with cementations materials, such as a sand and cement mixture. The mixture may also be pigmented to a selected color, as is known with conventional cementatious materials.

Figure 2:
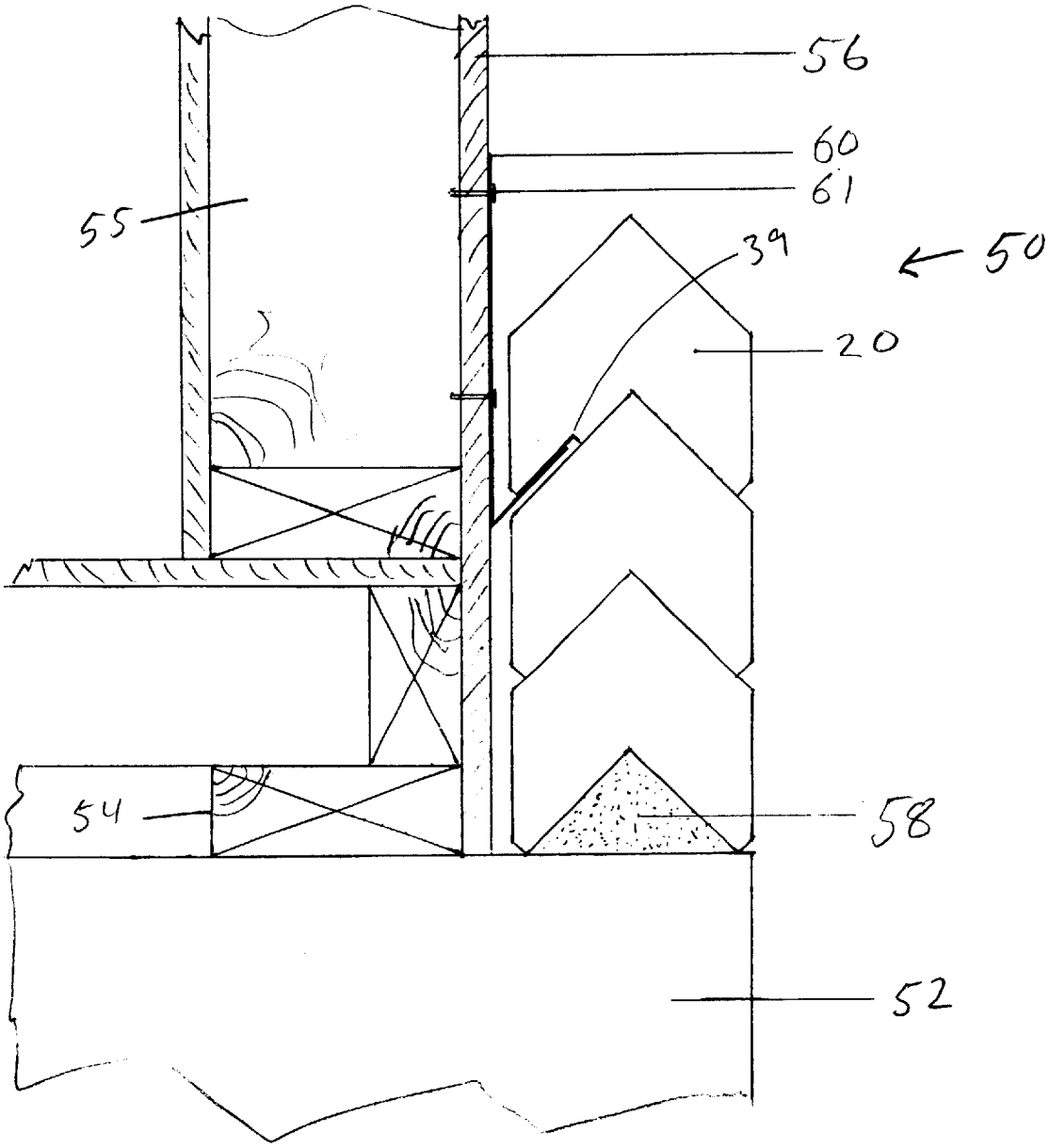
FIG. 2 illustrates an end view of a wall assembled with the block illustrated in FIG. 1.

FIG. 2 illustrates an end cross-sectional view of a is wall 50 assembled with the block 20 illustrated in FIG. 1. The wall 50 includes a foundation 52 capped by a header 54 from which a wall panel extends. The wall panel in the illustrated embodiment comprises a conventional stud framed wall in which studs 55 support construction sheeting 56. Mortar 58 applied to the upper surface of the foundation 52 connects a first course of blocks 20 to the foundation.

A metal tie or drip strip 60 attaches with screws 61 to the construction sheeting 58. The metal tie 60 is an elongate member that defines a substantially V-shaped channel (in cross-sectional view). A first portion is positioned against the construction sheeting 58 and receives the screws 61 for fastening the metal tie 60 to the wall 50. A second portion angles outwardly, and receives an edge portion of the block 20 with the recess 39 seating on extending portion of the tie 60.

A plurality of the blocks 20 thereafter are stacked and linearly engaged together to define a veneer for the wall 50. The peaks and opposing recesses of the blocks 20 interconnect the veneer face of the wall 50 which remains in place relative to the wall 50 without the ties 60. However, additional ties 60 may be used; for example, attached to a course for four feet with additional ties 60 at four foot vertical and horizontal spacings between other of the ties 60.

Figure 3:
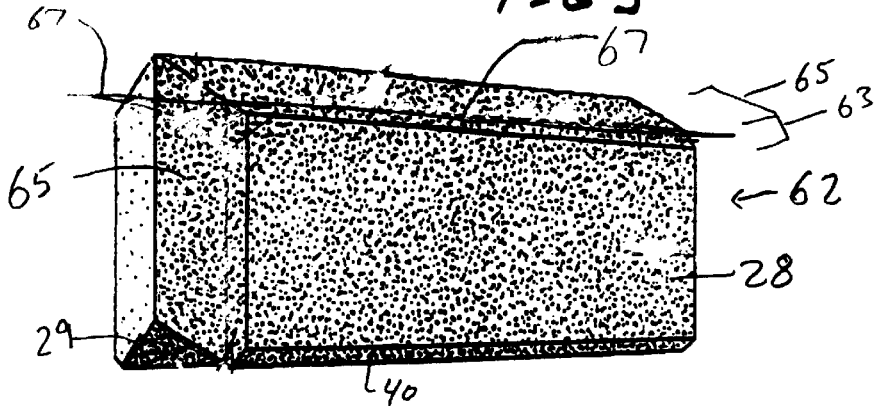
FIG. 3 illustrates a left perspective view of an alternate embodiment of the block illustrated in FIG. 1.

FIG. 3 illustrates a left perspective view of an alternate embodiment 62 of the block 20 illustrated in FIG. 1. The front face 28 is formed of fine sand cementatious mix 63. The cement used in the mixture is preferably white, which allows addition of a colorant to the blended mixture, so that the front face 28 provides an ornamental appearance. The sand mix material extends from an exterior surface of the block 20 through the body to a depth 67 defined by a plane substantially parallel to the front face 28. Preferably, the depth 67 is at least to a plane defined by the depth of the beveled edge 40. The remaining portion of the body extending from the depth of the face portion to the opposing back face 30 is made with a conventional gray cement-sand mix 65. The block 62 is manufactured by providing dual feeds of the different mixtures into a common presser or extruder.

Figure 4:
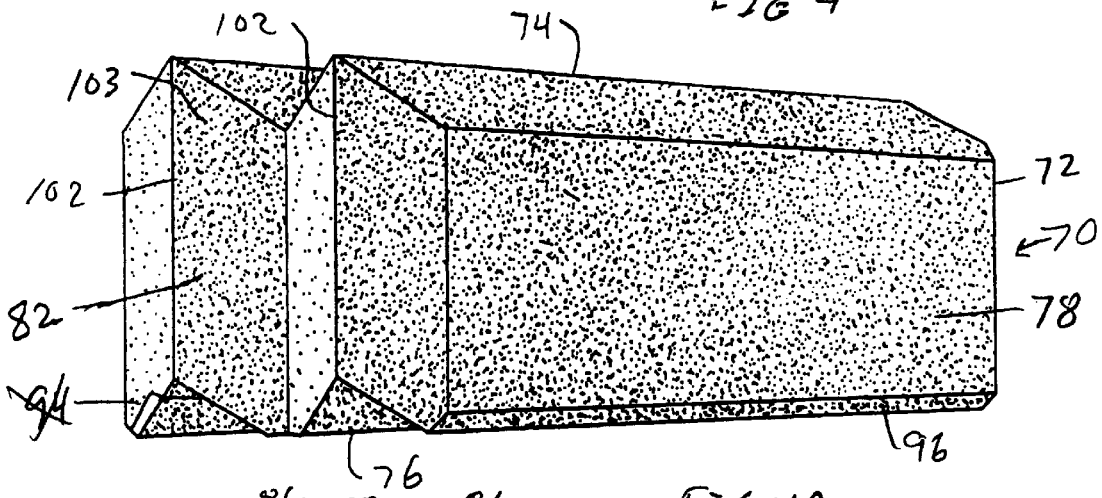
FIG. 4 illustrates a left perspective view of an alternate embodiment of the blocks according to the present invention.
Figure 4A:
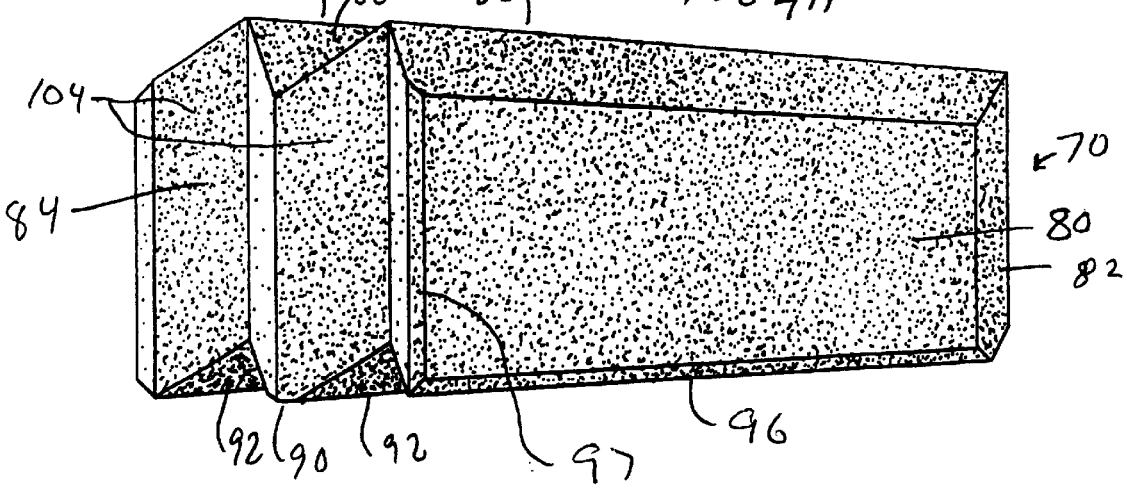
FIG. 4A illustrates a right perspective view of the block illustrated in FIG. 4.

Other blocks illustrated in FIGS. 4–8 illustrate structural blocks preferably for free-standing walls that are not necessarily attached to support such as the wall 50. FIG. 4 illustrates a left perspective view of an alternate embodiment 70 of the block according to the present invention, and FIG. 4A illustrates a right perspective view of the block 70. The block 70 comprises a body 72 having a top 74 and an opposing bottom 76, opposing front and back faces 78, 80, and a first and second opposing ends 82, 84. The top 74 defines a geometric protruding surface having a pair of peaks 86 spaced-apart and defining a valley 88. The bottom 76 defines a mating geometric surface with a peak 90 between valleys 92. Two of the blocks 70 thereby matingly engage when stacked in tiers one on top of another.

The front face 78 further defines a beveled edge 96 that extends substantially a length of the block 70 adjacent the bottom 76. As illustrated in FIG. 4A, the front face also defines a beveled side edge 97 that extends substantially a height of the block between the opposing top and bottom surfaces. The beveled edges 96, 97 cooperatively define an ornamental appearance for a wall made with the blocks 20, by defining simulated masonry joints between blocks in adjacent tiers and between linearly adjacent blocks in a course.

The first end 82 defines a pair of outwardly extending protrudences 102 which in the illustrated embodiment are V-shaped that are spaced-apart to define a valley 103 therebetween. As illustrated in FIG. 4A, the opposing second end 84 defines mating recesses 104 conforming substantially in shape to the protrudence 102. A pair of the blocks 70 linearly aligned in adjacent relation matingly engage with the protrudence 102 received in the recesses 104 for assembling a wall.

Figure 5:
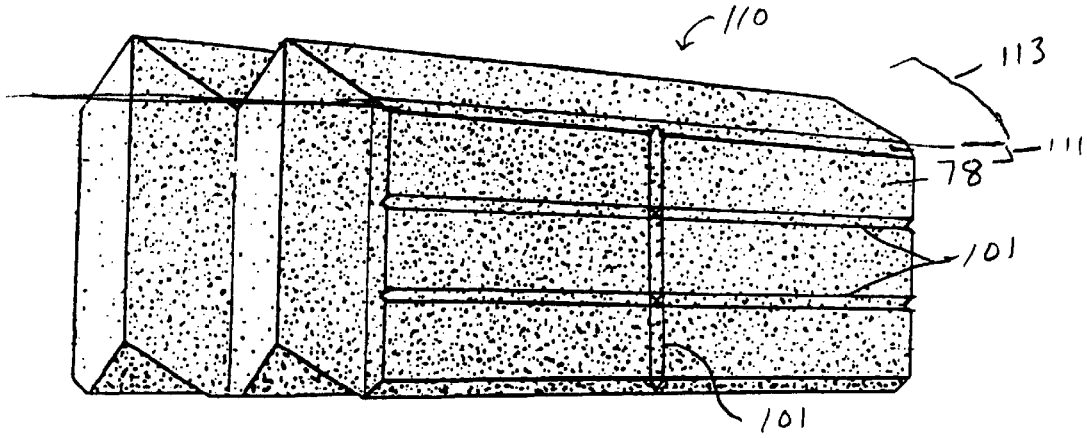
FIG. 5 illustrates a left perspective view of an alternate embodiment of the block illustrated in FIG. 4.

FIG. 5 illustrates a left perspective view of an alternate embodiment 110 of the block illustrated in FIG. 4. In this embodiment, the front face 78 defines spaced-apart grooves 101 in a first and second direction, preferably parallel to the respective side edges and top and bottom edges. The grooves 101 are substantially V-shaped, to simulate mortar joints and otherwise provide an ornamental appearance.

The front face 78 in the block 110 is formed of fine sand cementations mix 111, while the conventional gray cementatious mixture 113 forms the remainder of the block, as discussed above. The sand mix material extends from an exterior surface of the block 110 through the body to a depth defined by a plane substantially parallel to the front face 78. Preferably, the depth is at least to a plane defined by the depth of the beveled edge 40. The block 62 is manufactured by providing dual feeds of the different mixtures into a common presser or an extruder or in break-way molds defining the geometric interlocking surfaces of the blocks of the present invention.

Figure 6:
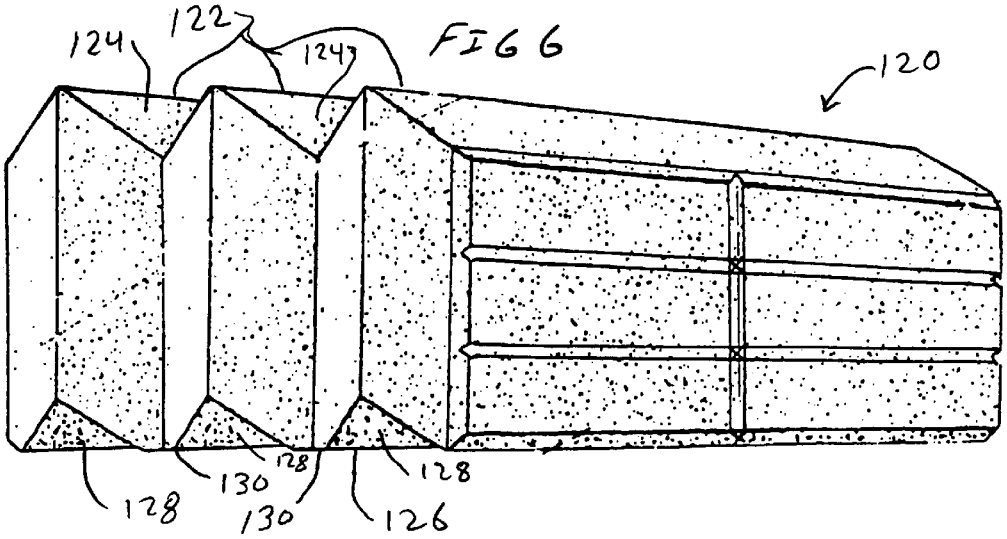
FIG. 6 illustrates a left perspective view of an alternate embodiment of the blocks according to the present invention.

FIG. 6 illustrates a left perspective view of an alternate embodiment 120 of the blocks according to the present invention. The block 120 defines three peaks 122 spaced-apart in the top surface which have two valleys 124 therebetween. The bottom 126 defines a mating geometric is surface with three valleys 128 and two peaks 130. Two of the blocks 120 thereby matingly engage when stacked in tiers one on top of another. In this embodiment, the front face can similarly be formed of a first material having a colorant while the remainder of the block 120 is formed of conventional cementations mix.

Figure 7:
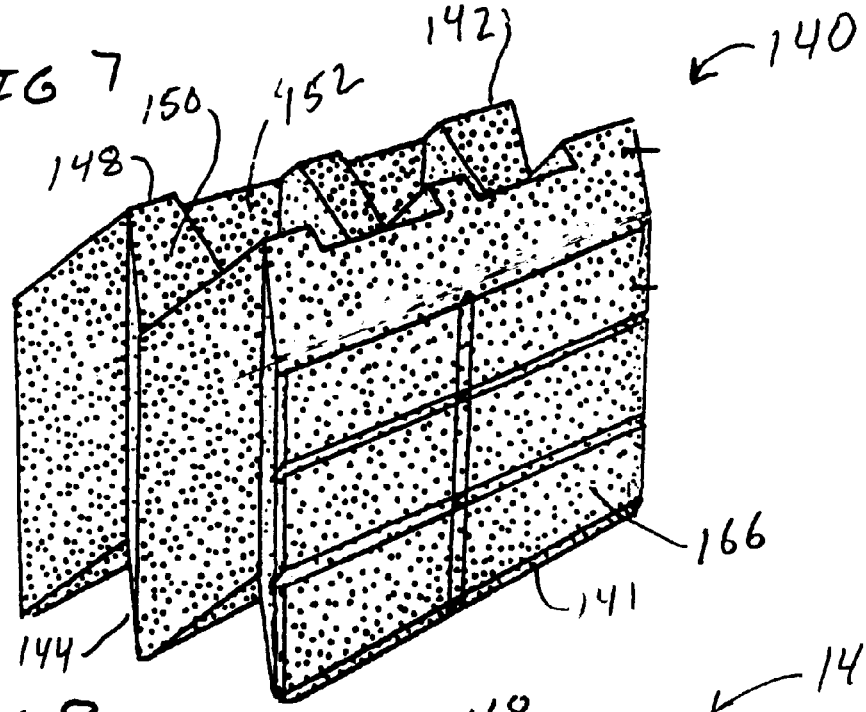
FIG. 7 illustrates a right perspective view of an alternate embodiment of the blocks according to the present invention.
Figure 8:
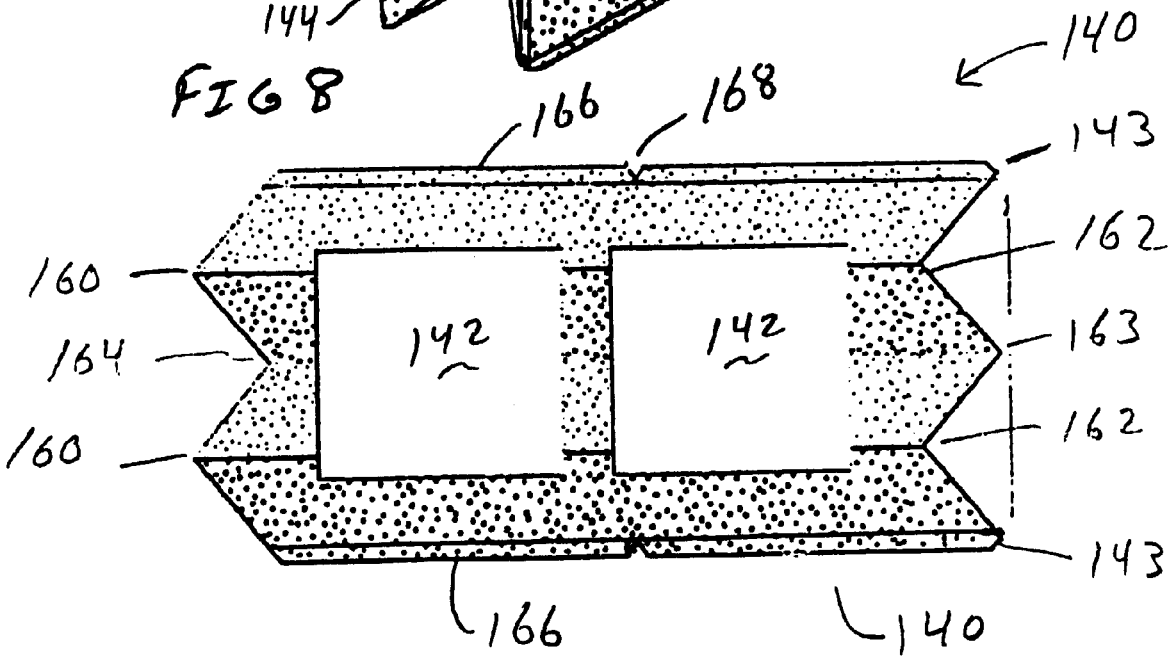
FIG. 8 illustrates a top plan view of the block illustrated in FIG. 7.

FIG. 7 illustrates a right perspective view of an alternate embodiment 140 of the block according to the present invention and FIG. 8 illustrates a top plan view. This embodiment illustrates the block 140 that defines spaced-apart passages 142 between a geometric top 144 and a mating geometric bottom 146. The front face defines beveled edges 140 and 141 for the ornamental purposes discussed above. The top surface 144 includes peaks 148 separated by valleys 150 therebetween. Further, the peaks 148 are spaced apart by aligned valleys 152. A bottom 154 defines opposing mating valleys and peaks, whereby two of the blocks 140 matingly connect in tiers. The opposing ends 156, 158 define mating peaks 160, 163 and valleys 162, 164. Linearly aligned blocks 140 accordingly matingly engage. The opposing back and front faces 166 define ornamental grooves 168 to simulate mortar joints. The block 140 may be formed with single cementatious mix, but, as illustrated in FIG. 8, the opposing faces 166 may also have face portions 167 of the colored sand mixture with an intermediate portion 169 of conventional gray cementations mix, thereby providing an ornamental appearance for the wall. As may be appreciated, an alternate embodiment of the block 140 is made with a plurality of spaced peaks and intermediate valleys such as the geometric protrudences in the block illustrated in FIG. 6 showing three peaks and two intermediate valleys.

Figure 9:
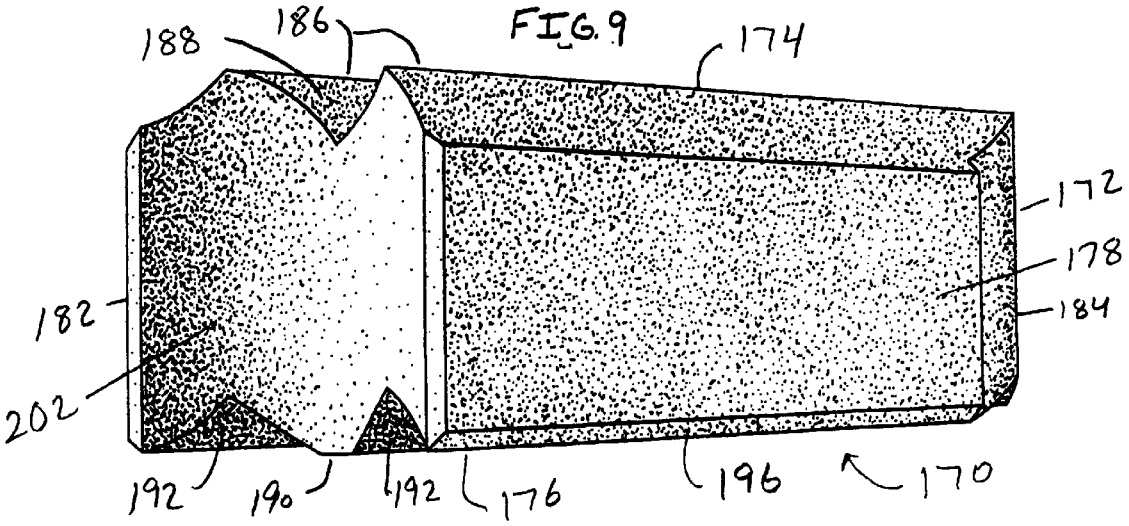
FIG. 9 illustrates a right perspective view of an alternate embodiment of the block according to the present invention.
Figure 10:
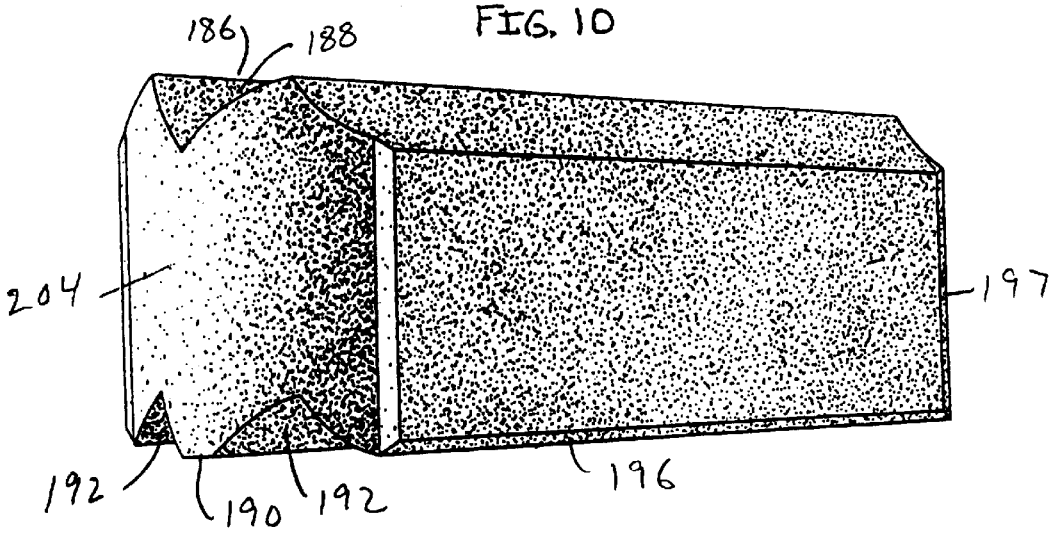
FIG. 10 illustrates a left perspective view of the alternate embodiment of the block illustrated in FIG. 9.
Figure 11:
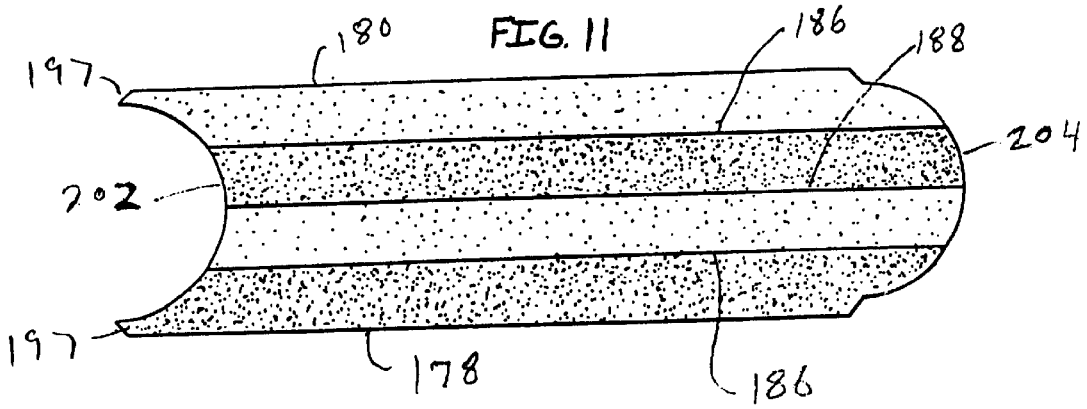
FIG. 11 illustrates a top plan view of the alternate embodiment illustrated in FIGS. 9 and 10.

Reference is made to FIGS. 9–11, in which FIG. 9 illustrates a right perspective view of an alternate embodiment of the block 170 according to the present invention, FIG. 10 illustrates a left perspective view thereof, and FIG. 11 is a top plan view thereof. The block 170 comprises a body 172 having a top 174 and an opposing bottom 176, opposing front and back faces 178, 180, and a first and second opposing ends 182, 184. The top 174 defines a geometric protruding surface having a pair of peaks 186 spaced-apart and defining a valley 188. The bottom 176 defines a mating geometric surface with a peak 190 between valleys 192. In the illustrated embodiment, the peak 190 is topped. Two of the blocks 170 thereby matingly engage when stacked in tiers one on top of another.

The front face 178 further defines a beveled edge 196 that extends substantially a length of the block 170 adjacent the bottom 176. As illustrated in FIG. 11, the front face also defines a beveled side edge 197 that extends substantially a height of the block between the opposing top and bottom. The beveled edges 196, 197 cooperatively define an ornamental appearance for a wall made with the blocks 170, by defining simulated masonry joints between blocks in adjacent tiers and between linearly adjacent blocks in a course.

In this embodiment, the first end 182 as illustrated in FIGS. 9 and 11 defines an arcuate inwardly extending recess 202. The opposing end 184 as illustrated in FIGS. 10 and 11 define an arcuate outwardly extending protrudence 204 that matingly conforms in shape to the recess 202. In a preferred embodiment, the exterior arcuate recess and surface are defined by at least a portion of a cylinder. A pair of the blocks 170 linearly aligned in adjacent relation matingly engage with the protrudence 204 received in the recess 204 of an adjacent block for assembling a wall. The arcuate mating protrudence 204 and recess 202 cooperatively allow the blocks 170 to follow an arcuate shape or path for a wall, for example, an "S-curve" or the like. As may be appreciated, an alternate embodiment of the block 170 is made with a plurality of spaced peaks and intermediate valleys such as the geometric protrudences in the block illustrated in FIG. 6 showing three peaks and two intermediate valleys.

FIGS. 12 and 13 illustrate a portion of walls constructed with the blocks 20 illustrated in FIGS. 1 and 1A. The protruding surfaces of the top 24 and the bottom 26 matingly engage in the peaks 36 and recesses 38. Similarly, the linearly aligned blocks interconnect at the opposing first and second ends in which the protrudence 42 of one block conformingly is received in the adjacent recess 44. Similar walls are likewise made of the structural blocks in the various embodiments disclosed herein.

While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A cementatious block for seating in adjacent and adjoining relation with a plurality of the cementatious blocks to define a wall, comprising:

a body having a top and an opposing bottom, opposing front and back faces, and a first and second opposing ends;

the top defining a geometric protruding surface and the bottom defining a mating geometric surface, whereby two of the block stacked one on another matingly engage together;

the front face formed of a first material extending from an exterior surface thereof through the body at least to a depth defined by a plane substantially parallel to the exterior surface with a remaining portion of the body extending therefrom to the opposing back face formed of a second material and further defining a beveled first edge extending substantially a length of the body adjacent the bottom and a beveled second side edge extending substantially a height of the body between the bottom and the top; and the first end defining a protrudence and the second end defining a recess conforming substantially in shape to the protrudence, whereby linearly adjacent blocks matingly engage for assemblying a wall therewith.

2. The cementatious block as recited in claim 1, wherein a portion of the bottom surface defines a notch recessed into a side face extending from a distal edge thereof for matingly engaging a drip strip attached to a footer of a foundation on which a plurality of the blocks are stacked and linearly engaged together to define the wall.

3. The cementatious block as recited in claim 1, wherein the geometric protruding surface defines a plurality of valleys and ridges extending longitudinally along the block and spaced apart between the front and back faces.

4. The cementatious block as recited in claim 3, wherein the valleys define substantially V-shaped depths and the ridges define substantially V-shaped peaks.

5. The cementatious block as recited in claim 1, wherein the protrudence defines an exterior arcuate surface.

6. The cementations block as recited in claim 5, wherein the exterior arcuate surface is defined by at least a portion of a cylinder comprising the protrudence.

7. The cementations block as recited in claim 6, wherein opposing edges between the front and back surfaces and the second opposing end define beveled faces, whereby linearly adjacent blocks engage at a selected oblique angle in a range of angles relative to a coaxial line defined by one of the blocks, such that a plurality of the blocks defines an arcuate line.

8. The cementations block as recited in claim 1, wherein an interior portion of the block defines at least one hole extending between the opposing top and bottom surfaces.

9. The cementatious block as recited in claim 1, wherein the geometric protruding surface of the top defines at least one substantially V-shaped peak and the geometric surface of the bottom defines at least one substantially V-shaped recess, whereby two of the block stacked one on another matingly engage together.

10. A wall constructed with a plurality of cementations blocks according to claim 1.

11. A cementatious block for seating in adjacent and adjoining relation with a plurality of the cementatious blocks to define a wall, comprising:

a body having a top and an opposing bottom, opposing front and back faces, and a first and second opposing ends;

the top defining a geometric protruding surface and the bottom defining a mating geometric surface, whereby two of the blocks stacked one on another matingly engage together;

the front face defining a beveled first edge extending substantially a length of the block adjacent the bottom surface and a beveled second side edge extending substantially a height of the body between the bottom and the top, the front face formed of a first material extending from an exterior surface thereof through the body at least to a depth defined by a plane substantially parallel to the exterior surface with a remaining portion of the body extending therefrom to the opposing back face formed of a second material;

the first end defining a protrudence and the second end defining a recess conforming substantially in shape to the protrudence, whereby linearly adjacent blocks matingly engage for assemblying a wall therewith; and a portion of the bottom surface defining a notch recessed into a side face extending from a distal edge thereof for matingly engaging a drip strip attached to a footer of a foundation on which a plurality of the blocks are stacked and linearly engaged together to define the wall.

12. The cementatious block as recited in claim 11, wherein the geometric protruding surface defines a plurality of valleys and ridges extending longitudinally along the block and spaced apart between the front and back faces.

13. The cementatious block as recited in claim 12, wherein the valleys define substantially V-shaped depths and the ridges define substantially V-shaped peaks.

14. The cementatious block as recited in claim 11, wherein the protrudence defines an exterior arcuate surface.

15. The cementations block as recited in claim 14, wherein the exterior arcuate surface is defined by at least a portion of a cylinder comprising the protrudence.

16. The cementatious block as recited in claim 14, wherein opposing edges between the front and back surfaces and the second opposing end define beveled faces, whereby linearly adjacent blocks engage at a selected oblique angle in a range of angles relative to a coaxial line defined by one of the blocks, such that a plurality of the blocks defines an arcuate line.

17. The cementatious block as recited in claim 11, wherein an interior portion of the block defines at least one hole extending between the opposing top and bottom surfaces.

18. The cementatious block as recited in claim 11, wherein the geometric protruding surface of the top defines at least one substantially V-shaped peak and the geometric surface of the bottom defines at least one substantially V-shaped recess, whereby two of the blocks stacked one on another matingly engage together.

19. A cementations block for seating in adjacent and adjoining relation with a plurality of the cementatious blocks to define a wall, comprising:

a body having a top and an opposing bottom, opposing front and back faces, and a first and second opposing ends;

the top defining a geometric protruding surface and the bottom defining a mating geometric surface, whereby two of the blocks stacked one on another matingly engage together;

the front face formed of a first material extending from an exterior surface thereof through the body at least to a depth defined by a plane substantially parallel to the exterior surface with a remaining portion of the body extending therefrom to the opposing back face formed of a second material;

the first end defining a protrudence and the second end defining a recess conforming substantially in shape to the protrudence, whereby linearly adjacent blocks matingly engage for assemblying a wall therewith; and portion of the bottom surface defining a notch recessed into a side face extending from a distal edge thereof for matingly engaging a drip strip attached to a footer of a foundation on which a plurality of the blocks are stacked and linearly engaged together to define the wall.

* * * * *

UNITED STATES PATENT AND TRADEMARK OFFICE

CERTIFICATE OF CORRECTION

PATENT NO. : 6,606,835 B1 
DATED : August 19, 2003
INVENTOR(S) : Augustin J. Bilka It is certified that error appears in the above-identified patent and that said Letters Patent is hereby corrected as shown below:

Column 8,
Line 21, add -- a -- before the word "portion".

Signed and Sealed this

Third Day of February, 2004

JON W. DUDAS
*Acting Director of the United States Patent and Trademark Office*